United States Patent [19]

Pisz et al.

[11] Patent Number: 4,824,328

[45] Date of Patent: Apr. 25, 1989

[54] TURBINE BLADE ATTACHMENT

[75] Inventors: Frank A. Pisz, Titusville, Fla.; Arthur S. Warnock, Bethlehem, Pa.; Roger W. Heinig, Cocoa Beach, Fla.

[73] Assignee: Westinghouse Electric Corp., Pittsburgh, Pa.

[21] Appl. No.: 53,237

[22] Filed: May 22, 1987

[51] Int. Cl.[4] ..... B21K 3/04

[52] U.S. Cl. ..... 416/219 R; 416/248

[58] Field of Search ..... 416/219 R, 220 R, 248

[56] References Cited

U.S. PATENT DOCUMENTS

| | | | |
|---|---|---|---|
| 3,045,968 | 7/1962 | Willis | 416/219 R |
| 3,756,745 | 9/1973 | Alver et al. | 416/248 |

FOREIGN PATENT DOCUMENTS

| | | | |
|---|---|---|---|
| 950557 | 10/1956 | Fed. Rep. of Germany | 416/219 R |
| 2512347 | 10/1975 | Fed. Rep. of Germany | 416/219 R |
| 677142 | 8/1952 | United Kingdom | 416/219 R |

OTHER PUBLICATIONS

European Patent #WO87/00778, Jul. 1986, Inventor; Andrew.

*Primary Examiner*—Robert E. Garrett
*Assistant Examiner*—John T. Kwan

[57] ABSTRACT

A structure for the root portion of a turbine blade and for the attachment grooves on a turbine rotor in conjunction with blades having integral shrouds and platforms as well as blades which are not attached to one another, blades which are joined by nonintegral shrouds and blades which do not include platforms. The invention is applicable to straight side entry blade roots and rotor grooves as well as curved side entry blades and curved rotor grooves. The invention results in reduced stress levels in the blade attachment structure by decreasing the land widths and increasing the fillet radii of curvature associated with each tang on a turbine blade root. In addition, the fillet radii of curvature are individually dimensioned to more uniformly distribute stress levels among blade root tangs. The reduction in land widths is accomplished by increasing land contact stresses for a given blade design.

11 Claims, 6 Drawing Sheets

TURBINE BLADE ATTACHMENT

This invention relates to bladed turbomachinery and, more particularly, to improved means for securing side entry blade roots within the grooves of a turbine rotor.

BACKGROUND OF THE INVENTION

In a turbomachine, such as a steam or gas turbine, a plurality of rotatable blades are arranged in a circular array about an axially aligned turbine rotor, each blade extending radially from the rotor. The rows of blades react to the forces of a working fluid flowing axially through the machine to produce rotation of the rotor and the blade rows. During operation the rotating blades experience pseudo-steady stresses caused by centrifugal forces and bending moments imposed by the working fluid. The periodic generation and removal of these stresses during turbine start-up and shut-down is known to contribute to low-cycle fatigue of the blade attachment structure. In addition, blade vibration may generate significant stresses on the attachment structure resulting in high cycle fatigue.

SUMMARY OF THE INVENTION

It is an object of the present invention to provide an improved design for securing turbine blades to a rotor which reduces the deleterious effects of centrifugal forces, bending moments and vibration on the integrity of the attachment structure.

It is another object of the invention to provide an improved design for securing turbine blades to a rotor which reduces the local peak stresses arising from centrifugal forces, bending moments and vibration.

It is a further object of the invention to provide an improved design which reduces cutting tool breakage during manufacture of rotor grooves.

in a generalized form of the invention there is provided an improved design for the root portion of a turbine blade and an improved design for the attachment grooves on a turbine rotor. The invention is for use in conjunction with blades having integral shrouds and platforms as well as blades which are not attached to one another, blades which are joined by nonintegral shrouds and blades which do not include platforms.

The invention is applicable to straight side entry blade roots and rotor grooves as illustrated in FIGS. 1, 2 and 3 as well as curved side entry blades and curved rotor grooves, e.g., those that follow a circular arc in a direction perpendicular to the cross-sectional views presented in FIGS. 2 and 3 such that they more nearly follow the arcuate shape of the associated foil portion. In one form, the invention results in reduced stress levels in the blade attachment structure by decreasing the land widths and increasing the fillet radii of curvature associated with each tang on a turbine blade root. In addition, the fillet radii of curvature are individually dimensioned to more uniformly distribute stress levels among blade root tangs. The reduction in land widths is accomplished by increasing land contact stresses in excess of those experienced in the prior art for a given blade design.

BRIEF DESCRIPTION OF THE DRAWINGS

The invention and its objects will become more apparent by reading the following detailed description in conjunction with the accompanying drawings, in which.

DETAILED DESCRIPTION OF THE PREFERRED EMBODIMENT

Figure 1:
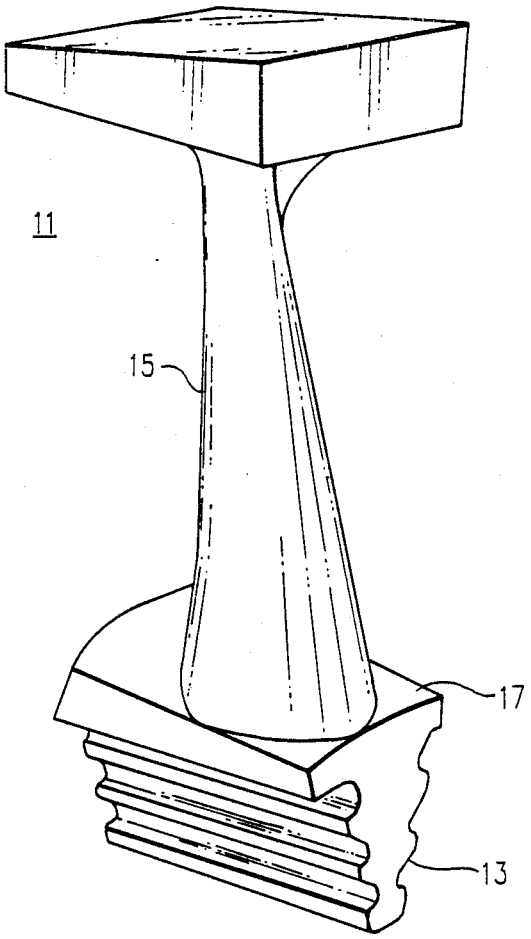
FIG. 1 is a perspective view of a turbine blade made in accordance with this invention.

FIG. 1 illustrates a straight side entry turbine blade 11 of the type used in steam turbines comprising a root 13, a foil 15 and a platform 17 interposed between the root 13 and the foil 15. As further illustrated in FIGS. 2, 3 and 4, the side entry blade root is bilaterally serrated and steeple shaped along a surface of symmetry 18. The blade 11 is secured against pseudo-static and dynamic forces by positioning the root 13 in a complementary shaped groove 19 on a turbine rotor 21 having a longitudinal axis of rotation (not shown). Many side entry steam turbine blade roots comprise an upper serrated portion 23, a middle serrated portion 25 and a lower serrated portion 27 in order to withstand centrifugal loadings and impart improved bending stiffness.

The upper serrated portion 23 comprises two upper tangs 31 arranged on opposite sides of the root 13 and positioned adjacent the blade platform 17. Two upper fillets 33, each having a radius of curvature rt, are spaced a distance d apart on opposite sides of the root 13 each fillet positioned between the upper tangs 31 and the platform 17. Two upper lands 35 each interposes between an adjoining upper fillet 33 and an upper tang 31 transfer forces from the upper serrated root portion 23 to the rotor 21 during turbine operation.

The middle serrated portion 25 extends from the upper portion 23 in a direction away from the platform 17, having two middle tangs 36 symmetrically positioned on opposite sides of the blade root 13 and two middle fillets 37 each positioned on an opposite side of the root 13 between an upper tang 31 and a middle tang 36. Two middle lands 41, each interposed between an adjoining middle fillet 37 and a middle tang 36, transfer forces from the middle serrated root portion 25 to the rotor 21 during turbine operation.

The lower serrated root portion 27 which extends from the middle portion 25 in a direction away from the platform 17 comprises two lower tangs 43 also symmetrically arranged on opposite sides of the root 13, a pair of lower fillets 45 each positioned between a middle tang 36 and a lower tang 43 and a pair of lower lands 47 interposed between an adjoining lower fillet 45 and a lower tang 43 for transferring forces from the lower serrated portion 27 to the rotor 21 during turbine operation.

In the past it has been common practice to limit the radii of curvature rt to values less than 0.09 d, rm to values less than 0.05 d and rb to values less than 0.05 d in order to minimize bending moments on the tangs 31, 36 and 43 and the stresses resulting therefrom. This is because an increase in radius of curvature requires that the land be repositioned outward along the tang with respect to the surface of symmetry 18. As a result, the bending moment of the land about the tang increases, offsetting the benefit of an increased radius of curvature. It has been found that one means of increasing the fillet radius of curvature without increasing bending moments on the tangs is to reduce the projected land width. The projected land width is a projection of the land along a plane perpendicular to the surface of symmetry 18 and parallel to a rotor axis. It is believed that projected land widths have not, in the past, been reduced below 0.67 rt for upper lands 35 because increased pressures on the lands 37 would crush the associated tangs 31 causing extrusion of the root 13 through the rotor groove 19. Similarly, projected widths for the middle and lower lands 41 and 47 have not been reduced below 1.38 rb respectively. However, it has been determined that in contrast to prior engineering design practice, the projected widths of lands 37, 41 and 47 may be decreased significantly below these limits, such as reducing the projected land widths for the upper, middle and lower lands 35, 41 and 47 to 0.52 rt, 1.04 rm and 0.98 rb, respectively. This is because the state of stress in the vicinity of lands is one of tri-axial compression within the root 13. This is known to inhibit structural yielding of the tangs. Experiment has verified that undesirable degrees of yielding which would result in crushing and extrusion do not occur with these proportionate projections of the land widths.

Figure 5:
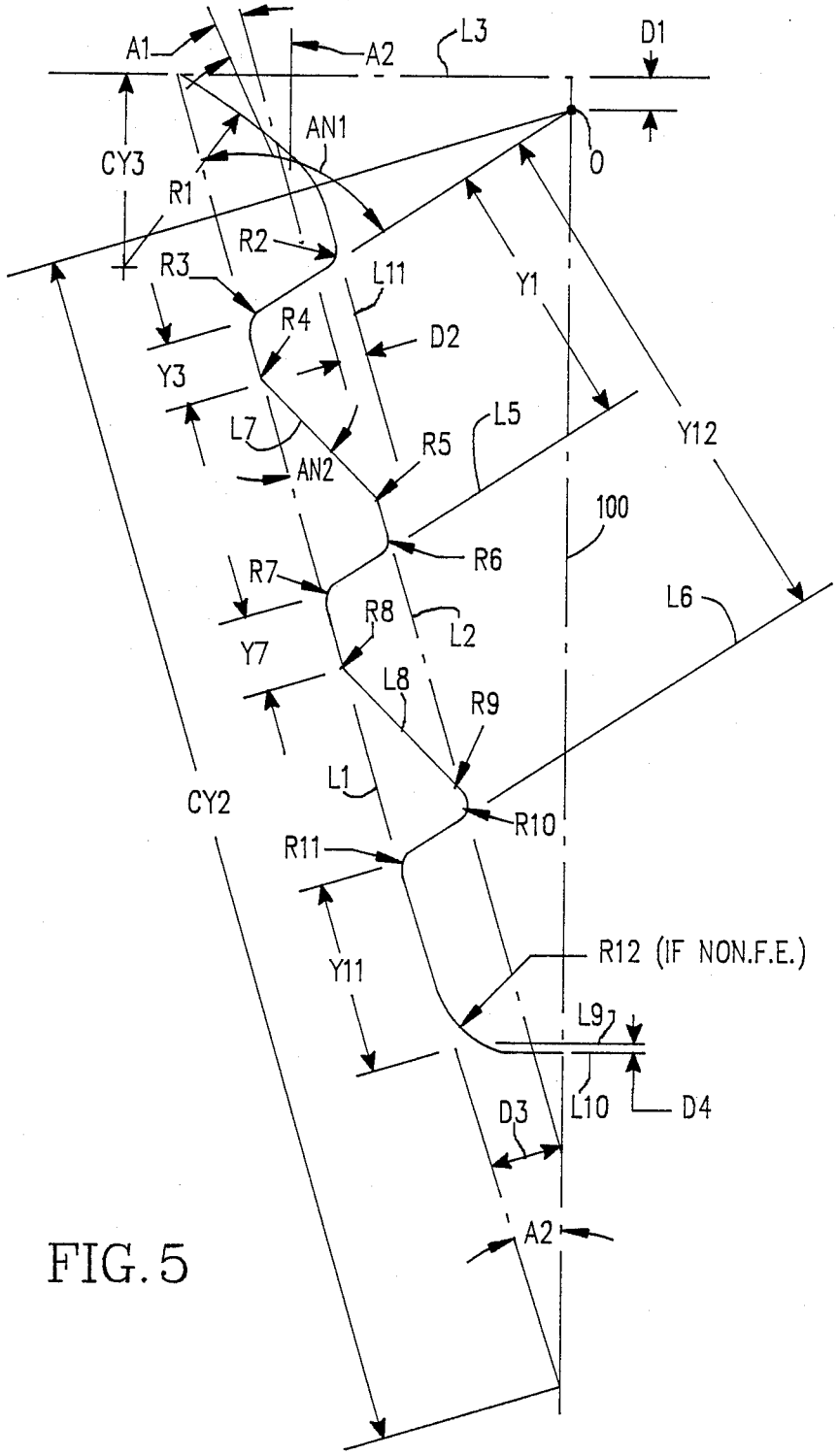
FIG. 5 is an enlarged line drawing showing the contour of the serrated portion of the steeple.

FIG. 5, a profile of a blade root contour, illustrates the relationship among parameters which may be used to further define the inventive root design in several embodiments. The particular embodiments are specifically defined by the numerical values of the parameters listed in the tables which follow.

Referring now to FIG. 5, the blade root contour is defined with respect to an origin 0. A straight line L1 is oriented at an angle A2 to the axis of symmetry 100, and intersecting the axis of symmetry 100 a distance CY2 times secant A2 below the origin. A straight line L2 oriented at an angle A2 minus A1 to the axis of symmetry, intersects the axis of symmetry at a point which is located a distance D3 from line L1, this distance being measured in a direction perpendicular to line L1. A straight line L3 is perpendicular to and intersects the axis of symmetry at a distance D1 above the origin, and defines the junction of the root 13 with the platform 17.

A straight line L4 extends from the origin at an angle AN1 measured from line L1. A straight line L5 is parallel to, and a distance Y1 below, line L4. A straight line L6 is parallel to, and a distance Y12 below, line L4. A straight line L7 oriented at an angle AN2 from line L1, intersects line L1 at a distance Y3 below the intersection of line L1 with line L4, the distance Y3 being measured along line L1. A straight line L8, parallel to line L7, intersects line L1 at a distance Y7 below the intersection of line L1 with line L5, the distance Y7 being measured along line L1. A straight line L9 is perpendicular to the axis of symmetry and intersects line L1 at a distance Y11 below the intersection of line L1 with line L6, the distance Y11 being measured along line L1.

A straight line L10 is parallel to and a distance D4 from and below line L9. A straight line L11 is parallel to and a distance D2 from line L2, the line L11 lying between line L2 and the origin 0. A circular arc of radius R1 is tangent to line L11 having a radius R1 and a center point lying a distance CY3 below line L3, the distance CY3 being measured perpendicular to line L3. A circular arc of radius R2, tangent to line L4 and to line L11, this radius being referred to as "rt" in FIG. 2.

A circular arc of radius R3 is tangent to line L4 and to line L1. A circular arc of radius R4 is tangent to line L1 and to line L7. A circular arc of radius R5 is tangent to line L7 and to line L2. A circular arc of radius R6 is tangent to line L2 and to line L5, this radius being referred to as "rm" in FIG. 2. A circular arc of radius R7 is tangent to line L5 and to line L1. A circular arc of radius R8 is tangent to line L1 and to line L8. A circular arc of radius R9 is tangent to line L8 and to line L2. A circular arc of radius R10 is tangent to line L2 and to line L6, this radius being referred to as "rb" in FIG. 2. A circular arc of radius R11 is tangent to line L6 and to line L1. A circular arc of radius R12 is tangent to line L1 and to line L10.

The nominal contour of root 13 is defined by following the arc of radius R1 from an intersection with line L3 to a tangency point with line L11; thence following line L11 to a tangency point with the arc of radius R2; thence following the arc of radius R2 to a tangency point with line L4; thence following line L4 to a tangency point with the arc of radius R3, this segment of L4 having been referred to above as an upper root land 35; thence following the arc of radius R3 to a tangency point with line L1; thence following line L1 to a tangency point with the arc of radius R4; thence following the arc of radius R4 to a tangency point with line L7; thence following line L7 to a tangency point with the arc of radius R5; thence following the arc of radius R5 to a tangency point with line L2; thence following line L2 to a tangency point with the arc of radius R6; thence following the arc of radius R6 to a tangency point with line L5; thence following line L5 to a tangency point with the arc of radius R7, this segment of L5 having been referred to above as middle root land 41; thence following the arc of radius R7 to a tangency point with line L1; thence following line L1 to a tangency point with the arc of radius R8; thence following the arc of radius R8 to a tangency point with line L8; thence following line L8 to a tangency point with the arc of radius R9; thence following the arc of radius R9 to a tangency point with line L2; thence following line L2 to a tangency point with the arc of radius R10; thence following the arc of radius R10 to a tangency point with line L6; thence following line L6 to a tangency point with the arc of radius R11, this segment of L6 having been referred to above as lower root land 47; thence following the arc of radius R11 to a tangency point with line L1; thence following line L1 to a tangency point with the arc of radius R12; thence following the arc of radius R12 to an intersection with line either line L9 or line L10; thence following a selected one of the lines L9 or L10 to an intersection with the root centerline 100.

For one embodiment of the novel root design, the numerical values of each of the several parameters are defined in table I, where linear dimensions are in inches and angular dimensions are in degrees and L3 corresponds to a lower surface of the platform 17. An alternate embodiment wherein the blade does not include a platform is also defined by the numerical values of table I, L3 there corresponding to a reference line along the junction of the blade foil 15 and the root 13, L3 being perpendicular to the axis of symmetry 100.

Second and third alternate embodiments of the root designs are defined by the numerical values listed in table II wherein linear dimensions are in inches and angular dimensions are in degrees, and L3 may correspond to either platform 17 or a reference line along the junction of the blade foil 15 and the root 13.

Again referencing to FIG. 5, a fourth alternate embodiment which includes an elliptical fillet is defined by the numerical values in Table III wherein instead of following line 11 to a tangency point with the arc of radius R12; thence following the arc of radius R12 to an intersection with line L9; and thence following line L9 to an intersection with the root centerline; the line L1 is followed to the upper end point of a smooth curve through several "ELLIPTICAL FILLET X AND Y COORDINATE POINTS", where the first of each pair of coordinate points indicates a distance measured perpendicular to the root centerline, and the second of each pair of coordinate points indicates a distance measured perpendicularly up from line L10; thence following the smooth curve to an intersection with line L10; and thence following line L10 to an intersection with the root centerline. Again, the numerical values of each of the several parameters defined in table III are in inches and angular dimensions are in degrees. In the fourth alternate embodiment, L3 represents the lower surface of a blade platform 17. In a fifth alternate embodiment, also based on FIG. 5 and table III, the blade does not include a platform 17 and line L3 again represents reference line along the junction of the blade foil 15 and the root 13.

Again, with reference to FIG. 5, tables IV, V, VI and VII, each list numerical values of the parameters for further alternate embodiments of the novel root design wherein, as for other tables, L3 may represent the bottom of a blade platform or a reference line taken along the junction of the blade foil 15 and the root 13. Linear dimensions are in inches and angular dimensions are in degrees.

The inventive concept of increasing the fillet radius of curvature while decreasing the projected land width in order to strengthen the fillet without increasing the bending moments on the associated tang is also applicable to the plurality of steeples 110 arranged in a circular array about the turbine rotor 21, adjacent steeples forming a plurality of grooves 19 for receiving turbine blade roots 13.

Figure 3:
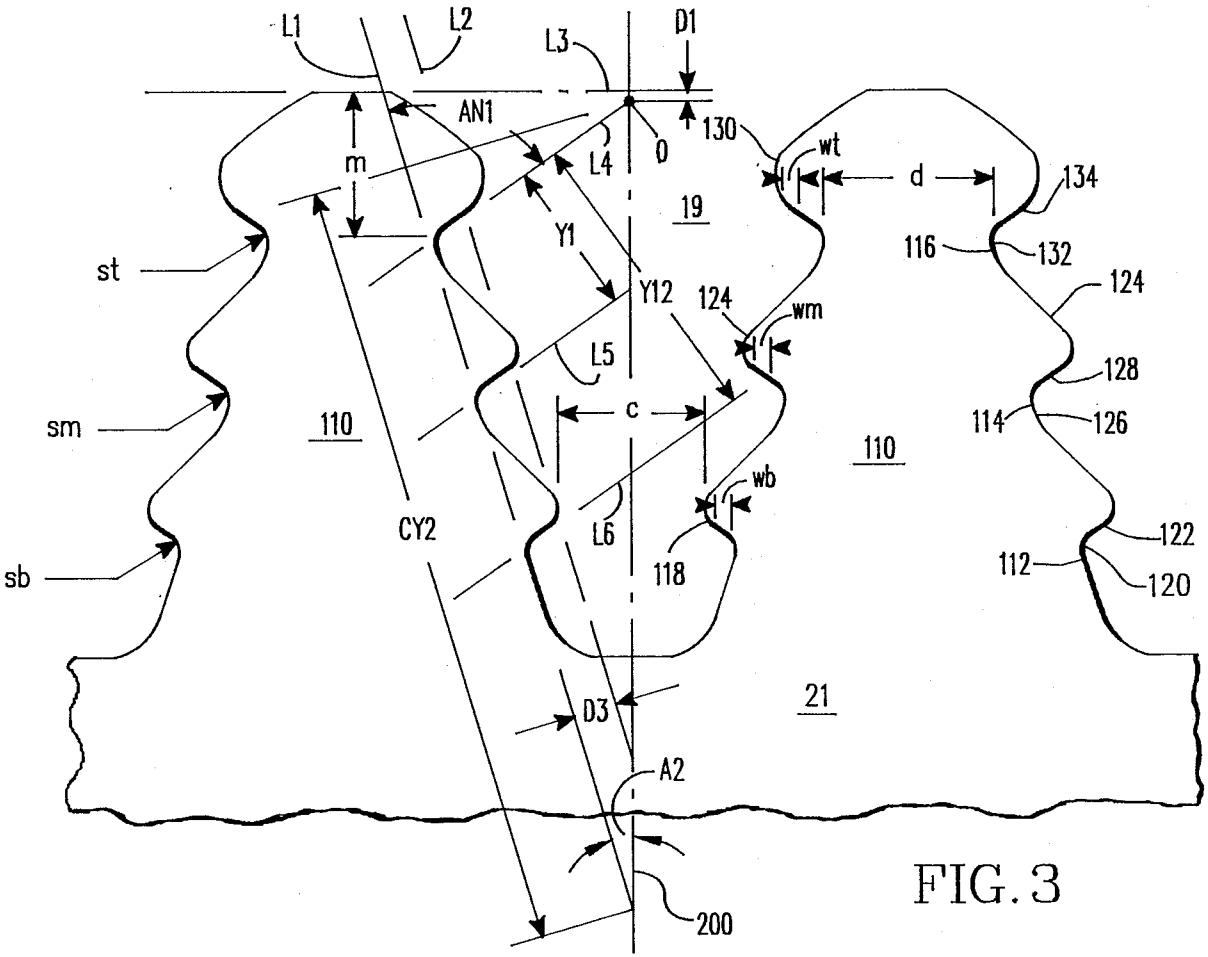
FIG. 3 is a partial elevational view of a turbine rotor showing a pair of steeples forming a serrated groove for receiving a serrated blade root.
Figure 4:
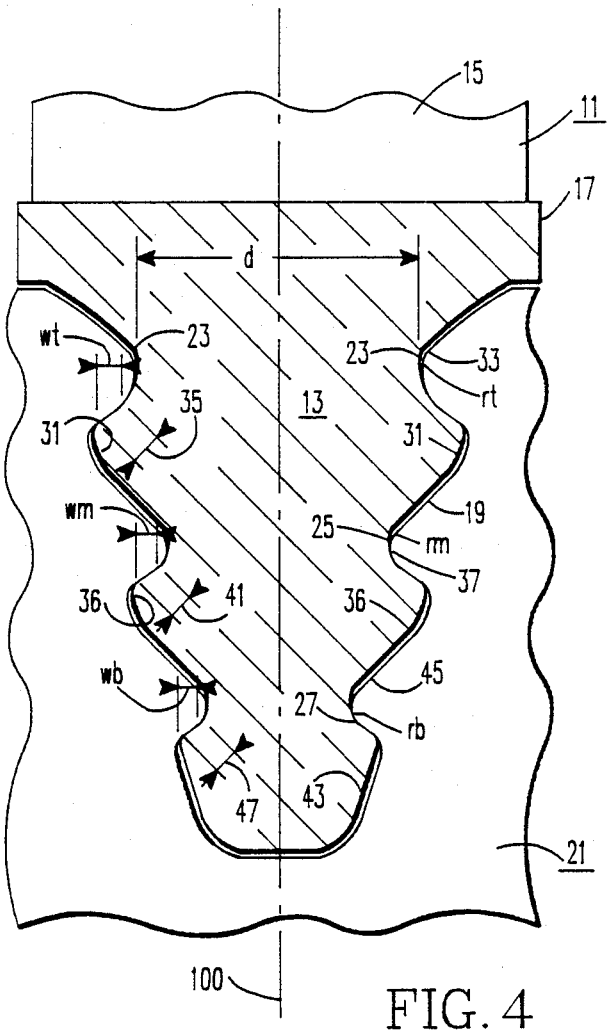
FIG. 4 is an elevational view of a portion of a turbine rotor and blade with the root portion of the turbine blade in section.

Each steeple, as illustrated in the partial view of a rotor in FIG. 3, comprises a lower serrated portion 112, a middle serrated portion 114 and an upper serrated portion 116 in order to withstand the forces received from the blade 11 during turbine operation.

Figure 2:
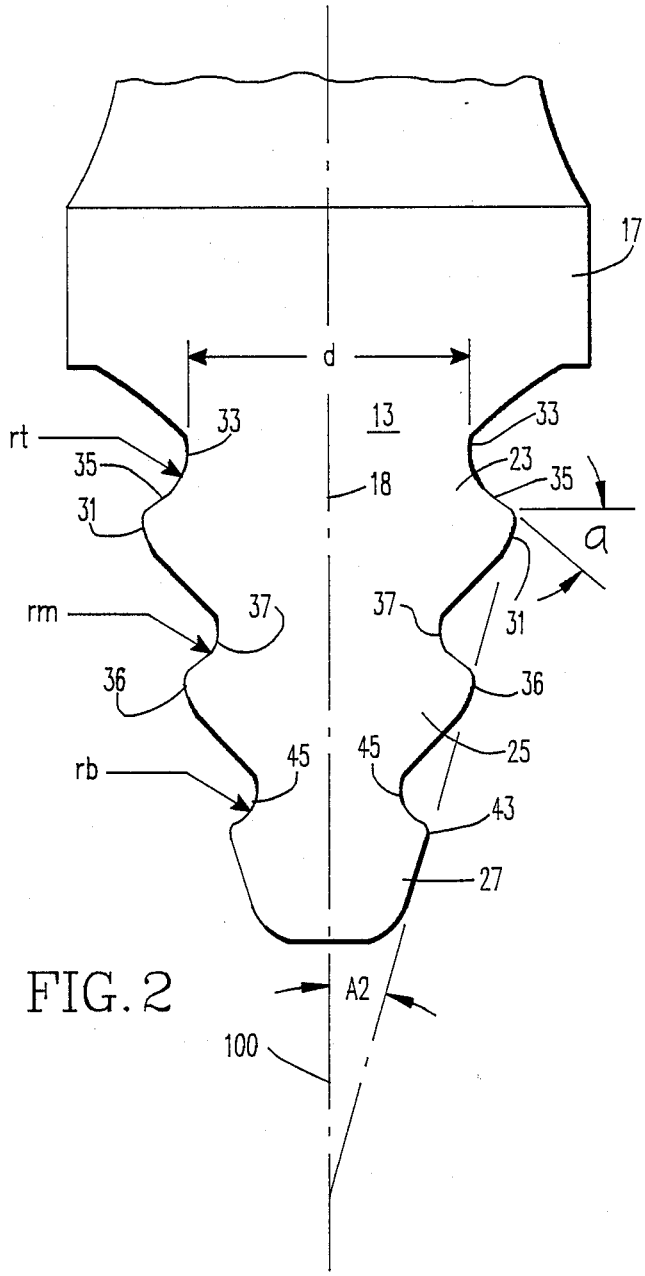
FIG. 2 is an elevational view of a root portion of the turbine blade.

The lower serrated portion 112 is positioned against the rotor 21 and includes a pair of lower tangs 118 symmetrically arranged on opposite sides of a steeple 110. A pair of lower fillets 120 each having a radius of curvature of at least 0.045 d, where d is the distance between the associated upper root fillets 33 illustrates in FIG. 2, are each positioned between the lower tang 118 and the rotor 21. The lower serrated portion 112 also includes a pair of lower lands 122 each interposed between a different lower fillet 120 and a lower tang 118 for receiving forces from the blade root. Each lower fillet 120 adjoins a different lower land 122.

Two lower lands 122, positionable to receive force from lower blade root lands 47, each have a projected width wb. Definition and measurement of the projected width of the lower land 122 and other steeple lands are analogous to the definition and measurement of the projected width for a root land 35, 41 or 47 as discussed above and will be apparent to thoseskilled in the art. According to the invention, wb is no greater than 1.75 sb, where sb is the radius of curvature of the lower fillet 120.

The middle serrated portion 114 extends from the lower portion 112 in a radial direction outward from the rotor axis 22 and includes a pair of middle tangs 124 symmetrically arranged on opposite sides of the steeple. A pair of middle fillets each having a radius of curvature, sm, more than 0.05 d, are each positioned between different lower and middle tangs 118 and 124. Two middle lands 128, positionable to receive forces from middle blade root lands 41, each have a projected width, wm, no greater than 1.75 sm. Each middle land is interposed between an adjoining middle fillet 126 and a middle tang 124.

The upper serrated portion 116 extends from the middle portion 114 in a radial direction outward from the rotor axis 22 and includes a pair of upper tangs 130 symmetrically arranged on opposite sides of the steeple. A pair of upper fillets 132 each having a radius of curvature st, of at least 0.7 d, preferably 0.8 d are positioned between different middle and upper tangs 124 and 130. Two upper lands 134, positionable to receive forces from upper blade root lands 35, each have a projected width, wt, no greater than 1.10 st. Each upper land is interposed between an adjoining upper fillet 132 and an upper tang 130.

FIG. 3, a profile of a steeple shaped groove contour, illustrates the relationship among parameters which may be used to further define the inventive steeple design in several embodiments. The particular embodiments are specifically defined by the numerical values of the parameters listed in the tables which follow.

Referring now to FIG. 3, the groove contour is defined with respect to an origin 0 positioned along the axis of symmetry 200 of the rotor groove 19. A straight line L1 is oriented at an angle A2 to the axis of symmetry, and intersecting the axis of symmetry 200 a distance CY2 times secant A2 below the origin. A straight line L2 oriented at an angle A2 minus A1 to the axis of symmetry, intersects the axis of symmetry at a point which is located a distance D3 from line L1, this distance being measured in a direction perpendicular to line L1. A straight line L3 perpendicular to and intersecting the axis of symmetry at a distance D1 above the origin, defines the junction of the root 13 and the platform 17. A straight line L4 extends from the origin at an angle AN1 measured from line L1. A straight line L5 is parallel to, and a distance Y1 below, line L4. A straight line L6 is parallel to, and a distance Y12 below, line L4. From the above description it will become apparent that the steeple groove 19 is designed as an image of the blade root 13. For simplicity, the reference characters used to describe the root 13 are used herein to describe the steeple groove 19. The balance of this description can be understood by reference to FIG. 5 while considering the drawing therein as a steeple and groove side rather than a root. A straight line L7 oriented at an angle AN2 from line L1, intersects line L1 at a distance Y3 below the intersection of line L1 with line L4, said distance Y3 being measured along line L1. A straight line L8, parallel to line L7, intersects line L1 at a distance Y7 below the intersection of line L1 with line L5, said distance Y7 being measured along line L1. A straight line L9 perpendicular to the axis of symmetry intersects line L1 at a distance Y11 below the intersection of line L1 with line L6, said distance Y11 being measured along line L1. A straight line L11 is parallel to and a distance D2 from line L2, said line L11 lying between line L2 and the origin 0. A circular arc of radius R1 is tangent to line L11, having a radius R1 and a center point lying a distance CY3 below line L3, said distance CY3 being measured perpendicular to line L3. A circular arc of radius R2 is tangent to line L4 and line L11. A circular arc of radius R3 is tangent to line L4 and to line L1, this radius having been referred to above as "st". A circular arc of radius R4 is tangent to line L1 and to line L7. A circular arc of radius R5 is tangent to line L7 and to line L2. A circular arc of radius R6 is tangent to line L2 and to line L5. A circular arc of radius R7 is tangent to line L5 and to line L1, this radius having been referred to above as "sm". A circular arc of radius R8 is tangent to line L1 and to line L8. A circular arc of radius R9 is, tangent to line L8 and to L2. A circular arc of radius R10 is tangent to line L2 and to line L6. A circular arc of radius R11 is tangent to line L6 and to line L1, this radius having been referred to above as "sb". A circular arc of radius R12 is tangent to line L1 and to line L9.

The nominal contour of the groove 19 is defined by following the arc of radius R1 from an intersection with line L3 to a tangency point with line L11; thence following line L11 to a tangency point with the arc of radius R2, thence following the arc of radius R2 to a tangency point with line L4; thence following line L4 to a tangency point with the arc of radius R3, this segment having been referred to above as upper steeple land 134; thence following the arc of radius R3 to a tangency point with line L1; thence following line L1 to a tangency point with the arc of radius R4; thence following the arc of radius R4 to a tangency point with line L7; thence following line L7 to a tangency point with the arc of radius R5; thence following the arc of radius R5 to a tangency point with line L2; thence following line L2 to a tangency point with the arc of radius R6; thence following the arc of radius R6 to a tangency point with line L5; thence following line L5 to a tangency point with the arc of radius R7, this segment having been referred to above as a middle steeple land 128; thence following the arc of radius R7 to a tangency point with line L1; thence following line L1 to a tangency point with the arc of radius R8; thence following the arc of radius R8 to a tangency point with line L8; thence following line L8 to a tangency point with the arc of radius R9; thence following the arc of radius R9 to a tangency point with line L2; thence following line L2 to a tangency point with the arc of radius R10; thence following the arc of radius R10 to a tangency point with line L6; thence following line L6 to a tangency point with the arc of radius R11, this segment having been referred to above as the lower steeple land 122; thence following the arc of radius R11 to a tangency point with line L1; thence following line L1 to a tangency point with the arc of radius R12, thence following the arc of radius R12 to a tangency point with line L9; thence following line L9 to an intersection with the groove centerline 200.

For two preferred embodiments of the novel groove profile design, the numerical values of each of the several parameters are defined in tables VIII and IX, where linear dimensions are in inches and angular dimensions are in degrees.

Figure 6:
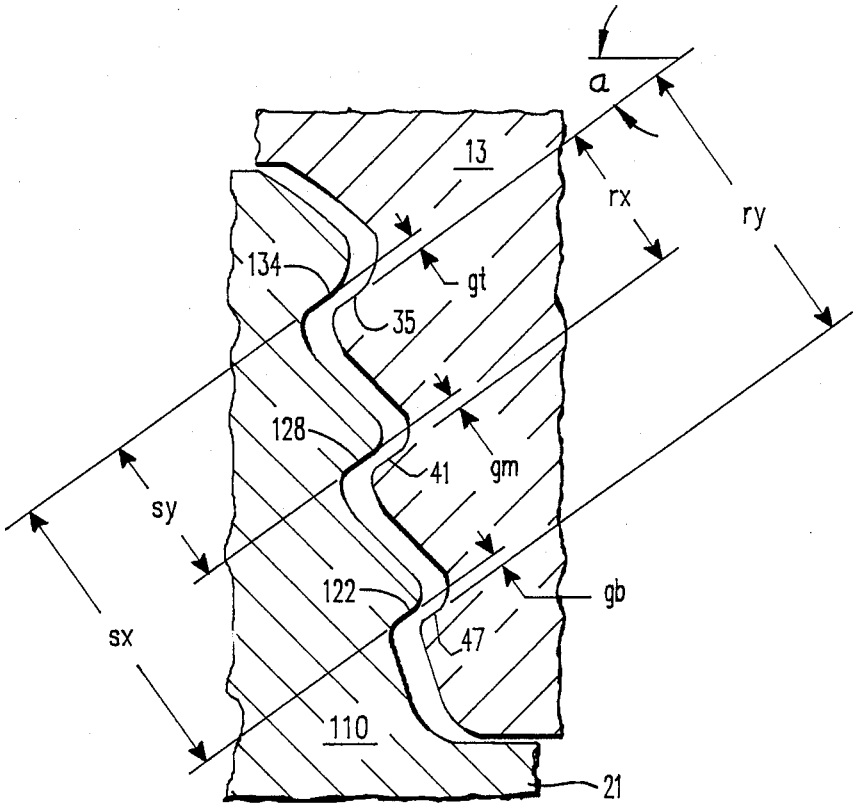
FIG. 6 is a partial sectional view of a steeple and blade showing the registration of the blade root and serrated steeple.

Once more referring to FIGS. 5 and 6, alternate embodiments which include an elliptical fillet are defined by the numeric values in Tables X, XI, XII, XIII and XIV, where instead of following line L1 to a tangency point with the arc of radius R12, the line L1 is followed to the upper end point of a smooth curve through several "ELLIPTICAL FILLET X AND Y COORDINATE POINTS", where the first of each pair of coordinate points indicates a distance measured perpendicular to the groove centerline 200 and the second of each pair of coordinate points indicates a distance measured perpendicularly down from line L9. This smooth curve is then followed to an intersection with the groove centerline.

Further stress reductions in the fillets of blade roots and rotor steeples may be achieved through a more uniform distribution of loads on the upper, middle and lower pairs of adjacent root and steeple lands. In the past, efforts to more uniformly distribute loads on blade root lands have been avoided because of concern for blade vibrations which occur when there is not contact between the upper blade root land and the upper steeple land. In order to assure contact between these lands prior designs have generally required that there be no gap between the upper root lands 35 and the upper steeple lands 134 at zero speed. This requirement has, in turn, resulted in relatively high stress levels on the upper lands 35, 134 and the upper fillets 33, 132 because proportionately low levels of force are transferred between the middle land pairs 41 and 128 and the lower land pairs 47 and 122. However, it has been found that contact between upper lands 35 and 134 may be assured at operating speeds without requiring contact between the upper lands at zero speed. It would be advantageous to provide a small gap between pairs of upper steeple and root pairs in order to achieve closure between middle land pairs 41 and 128 and between lower land pairs 47 and 128. This will result in a more uniform distribution of stresses through the lands thus reducing peak stress levels in the blade roots 13 and in the rotor steeples 110.

Referring now to FIG. 6 there is illustrated in cross section for one embodiment of the invention one side of a bilaterally symmetric blade root 13 positioned against a complementary side of a rotor steeple 110. The upper, middle and lower steeple lands 134, 128, 122 are substantially flat surfaces which are substantially parallel to one another. Similarly, the upper, middle and lower root lands 35, 41 and 47 are also substantially flat surfaces which are parallel to one another. The upper root land 35 is positionable at distance gt ranging up to 0.0001" away from the adjacent upper steeple land, at zero turbine speed, which range assures contact between the upper root and steeple lands 35, 134 at operating speed. The middle root land 41 is positionable at distance gm ranging up to 0.0009" from the adjacent middle steeple land 128 and the lower root land 47 is positionable a distance gb ranging up to 0.0006" from the lower steeple land 122. It has been determined that blade root lands spaced according to these ranges from adjacent steeple lands at zero speed result in a more uniform distribution of peak stresses across the lands at turbine operating speeds than has been known in the prior art. Furthermore, it has been found that by selecting a range of values for the spacing gm which differ from the range of values for the spacing gb, more uniform stress distribution can be attained among lands than has previously been available in blade attachment designs which specify the same range of values for gm and gb.

The above-specified ranges of distance between adjacent steeple and rotor lands may be achieved by selective spacing between parallel lands on each side of the steeples and on each side of the grooves. In particular, the spacing rx between the upper and middle root lands 35 and 41 should range between 0.6013" and 0.6018" and the spacing ry between the upper and lower root lands 35 and 47 should range between 1.1420' and 1.1425". Similarly, the spacing sx between the upper and middle steeple lands 134 and 128 should range between 0.6013" and 0.6018" and the spacing sy between the upper and lower steeple lands 134 and 122 should range between 1.1420" and 1.1425".

TABLE I

| | | |
|---|---|---|
| .6094 | R1 | TOP LAND RADIUS |
| .17 | R2 | FIRST LAND INNER RADIUS |
| .086 | R3 | FIRST LAND OUTER RADIUS |
| .086 | R4 | SECOND LAND OUTER RELIEF RADIUS |
| .093 | R5 | SECOND LAND INNER RELIEF RADIUS |
| .093 | R6 | SECOND LAND INNER RADIUS |
| .055 | R7 | SECOND LAND OUTER RADIUS |
| .055 | R8 | THIRD LAND OUTER RELIEF RADIUS |
| .093 | R9 | THIRD LAND INNER RELIEF RADIUS |
| .093 | R10 | THIRD LAND INNER RADIUS |
| .049 | R11 | THIRD LAND OUTER RADIUS |
| .15 | R12 | BOTTOM RADIUS |
| .7028 | Y1 | FIRST TO SECOND LAND BEARING SURFACE DISTANCE |
| .1576 | Y3 | TOP LAND OUTER THICKNESS |
| .0992 | Y7 | SECOND LAND OUTER THICKNESS |
| .3148 | Y11 | BOTTOM LAND OUTER THICKNESS |
| 1.3348 | Y12 | FIRST TO THIRD LAND BEARING SURFACE DISTANCE |
| 2.9514 | CY2 | OUTER CONSTRUCTION ANGLE VERTEX LOCATION |
| .5384 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0197 | D1 | OUTER ANGLE CONSTRUCTION POINT |
| .0446 | D2 | TOP RADIUS OFFSET |
| .1883 | D3 | LAND WIDTH |
| .01 | D4 | BOTTOM OFFSET DISTANCE |
| .853669 | A1 | INNER CONSTRUCTION ANGLE |
| 17.652368 | A2 | OUTER CONSTRUCTION ANGLE |

TABLE II

| | | |
|---|---|---|
| .5214 | R1 | TOP LAND RADIUS |
| .1455 | R2 | FIRST LAND INNER RADIUS |
| .0736 | R3 | FIRST LAND OUTER RADIUS |
| .0736 | R4 | SECOND LAND OUTER RELIEF RADIUS |
| .0796 | R5 | SECOND LAND INNER RELIEF RADIUS |
| .0796 | R6 | SECOND LAND INNER RADIUS |
| .0471 | R7 | SECOND LAND OUTER RADIUS |
| .0471 | R8 | THIRD LAND OUTER RELIEF RADIUS |
| .0796 | R9 | THIRD LAND INNER RELIEF RADIUS |
| .0796 | R10 | THIRD LAND INNER RADIUS |
| .0419 | R11 | THIRD LAND OUTER RADIUS |
| .1283 | R12 | BOTTOM RADIUS |
| .6014 | Y1 | FIRST TO SECOND LAND BEARING SURFACE DISTANCE |
| .1348 | Y3 | TOP LAND OUTER THICKNESS |
| .0849 | Y7 | SECOND LAND OUTER THICKNESS |
| .2693 | Y11 | BOTTOM LAND OUTER THICKNESS |
| 1.1421 | Y12 | FIRST TO THIRD LAND BEARING SURFACE DISTANCE |
| 2.5252 | CY2 | OUTER CONSTRUCTION ANGLE VERTEX LOCATION |
| .4607 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0169 | D1 | OUTER ANGLE CONSTRUCTION POINT |
| .0382 | D2 | TOP RADIUS OFFSET |
| .1611 | D3 | LAND WIDTH |
| .0086 | D4 | BOTTOM OFFSET DISTANCE |
| .853669 | A1 | INNER CONSTRUCTION ANGLE |
| 17.652368 | A2 | OUTER CONSTRUCTION ANGLE |

TABLE III

| | | |
|---|---|---|
| .6094 | R1 | TOP LAND RADIUS |
| .17 | R2 | FIRST LAND INNER RADIUS |
| .086 | R3 | FIRST LAND OUTER RADIUS |

TABLE III-continued

| | | |
|---|---|---|
| .086 | R4 | SECOND LAND OUTER RELIEF RADIUS |
| .093 | R5 | SECOND LAND INNER RELIEF RADIUS |
| .093 | R6 | SECOND LAND INNER RADIUS |
| .055 | R7 | SECOND LAND OUTER RADIUS |
| .055 | R8 | THIRD LAND OUTER RELIEF RADIUS |
| .093 | R9 | THIRD LAND INNER RELIEF RADIUS |
| .093 | R10 | THIRD LAND INNER RADIUS |
| .049 | R11 | THIRD LAND OUTER RADIUS |
| .7028 | Y1 | FIRST TO SECOND LAND BEARING SURFACE DISTANCE |
| .1576 | Y3 | TOP LAND OUTER THICKNESS |
| .0992 | Y7 | SECOND LAND OUTER THICKNESS |
| .3253 | Y11 | BOTTOM LAND OUTER THICKNESS |
| 1.3348 | Y12 | FIRST TO THIRD LAND BEARING SURFACE DISTANCE |
| 2.9514 | CY2 | OUTER CONSTRUCTION ANGLE VERTEX LOCATION |
| .5384 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0197 | D1 | OUTER ANGLE CONSTRUCTION POINT |
| .0446 | D2 | TOP RADIUS OFFSET |
| .1883 | D3 | LAND WIDIH |
| .01 | D4 | BOTTOM OFFSET DISTANCE |
| .853669 | A1 | INNER CONSTRUCTION ANGLE |
| 17.652368 | A2R | OUTER CONSTRUCTION ANGLE |
| * | REFX,REFY | ELLIPTICAL FILLET X AND Y COORDINATE POINTS |
| .0 | −.0100 | |
| .0694 | −.0100 | |
| .1041 | −.0078 | |
| .1373 | −.0014 | |
| .1680 | .0086 | |
| .1953 | 0214 | |
| .2188 | .0365 | |
| .2385 | .0529 | |
| .2547 | .0702 | |
| .2674 | .0878 | |
| .2772 | .1059 | |
| .2842 | .1239 | |

TABLE IV

| | | |
|---|---|---|
| 0.5214 | R1 | TOP LAND RADIUS |
| 0.1455 | R2 | FIRST LAND INNER RADIUS |
| 0.0736 | R3 | FIRST LAND OUTER RADIUS |
| 0.0736 | R4 | SECOND LAND OUTER RELIEF RADIUS |
| 0.0796 | R5 | SECOND LAND INNER RELIEF RADIUS |
| 0.0796 | R6 | SECOND LAND INNER RADIUS |
| 0.0471 | R7 | SECOND LAND OUTER RADIUS |
| 0.0471 | R8 | THIRD LAND OUTER RELIEF RADIUS |
| 0.0796 | R9 | THIRD LAND INNER RELIEF RADIUS |
| 0.0796 | R10 | THIRD LAND INNER RADIUS |
| 0.0419 | R11 | THIRD LAND OUTER RADIUS |
| 0.6014 | Y1 | FIRST TO SECOND LAND BEARING SURFACE DISTANCE |
| 0.1348 | Y3 | TOP LAND OUTER THICKNESS |
| 0.0849 | Y7 | SECOND LAND OUTER THICKNESS |
| 0.2603 | Y11 | BOTTOM LAND OUTER THICKNESS |
| 1.1421 | Y12 | FIRST TO THIRD LAND BEARING SURFACE DISTANCE |
| 2.5252 | CY2 | OUTER CONSTRUCTION ANGLE VERTEX LOCATION |
| 0.4607 | CY3 | TOP RADIUS CENTER LOCATION |
| 67.652368 | AN1 | LAND BEARING SURFACE ANGLE |
| 28.722320 | AN2 | LAND UNDERSIDE ANGLE |

TABLE IV-continued

| | | |
|---|---|---|
| .0169 | D1 | OUTER ANGLE CONSTRUCTION POINT |
| 0.0382 | D2 | TOP RADIUS OFFSET |
| 0.1611 | D3 | LAND WIDTH |
| 0.0086 | D4 | BOTTOM OFFSET DISTANCE |
| 0.853669 | A1 | INNER CONSTRUCTION ANGLE |
| 17.652368 | A2 | OUTER CONSTRUCTION ANGLE |
| * | REFX,REFY | ELLIPTICAL FILLET X AND Y COORDINATE POINTS |
| 0.0 | −.0086 | |
| .0594 | −.0086 | |
| .0891 | −.0067 | |
| .1175 | −.0012 | |
| .1437 | .0073 | |
| .1671 | .0183 | |
| .1872 | .0312 | |
| .2041 | .0452 | |
| .2179 | .0600 | |
| .2288 | .0751 | |
| .2372 | .0906 | |
| .2432 | .1060 | |

TABLE V

| | | |
|---|---|---|
| .4398 | R1 | TOP LAND RADIUS |
| .1227 | R2 | FIRST LAND INNER RADIUS |
| .0621 | R3 | FIRST LAND OUTER RADIUS |
| .0621 | R4 | SECOND LAND OUTER RELIEF RADIUS |
| .0671 | R5 | SECOND LAND INNER RELIEF RADIUS |
| .0671 | R6 | SECOND LAND INNER RADIUS |
| .0397 | R7 | SECOND LAND OUTER RADIUS |
| .0397 | R8 | THIRD LAND OUTER RELIEF RADIUS |
| .0671 | R9 | THIRD LAND INNER RELIEF RADIUS |
| .0671 | R10 | THIRD LAND INNER RADIUS |
| .0354 | R11 | THIRD LAND OUTER RADIUS |
| .5072 | Y1 | FIRST TO SECOND LAND BEARING SURFACE DISTANCE |
| .1137 | Y3 | TOP LAND OUTER THICKNESS |
| .0716 | Y7 | SECOND LAND OUTER THICKNESS |
| .2154 | Y11 | BOTTOM LAND OUTER THICKNESS |
| .9632 | Y12 | FIRST TO THIRD LAND BEARING SURFACE DISTANCE |
| 2.2457 | CY2 | OUTER CONSTRUCTION ANGLE VERTEX LOCATION |
| .3885 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0257 | D1 | OUTER ANGLE CONSTRUCTION POINT |
| .0322 | D2 | TOP RADIUS OFFSET |
| .1345 | D3 | LAND WIDTH |
| .0072 | D4 | BOTTOM OFFSET DISTANCE |
| .853669 | A1 | INNER CONSTRUCTION ANGLE |
| 16.652368 | A2 | OUTER CONSTRUCTION ANGLE |
| * | REFX,REFY | ELLIPTICAL FILLET X AND Y COORDINATE POINTS |
| 0.0 | −.0072 | |
| .0635 | −.0072 | |
| .0922 | −.0054 | |
| .1196 | −.0001 | |
| .1444 | .0081 | |
| .1662 | .0186 | |
| .1845 | .0304 | |
| .1996 | .0432 | |
| .2117 | .0565 | |
| .2211 | .0699 | |
| .2281 | .0833 | |
| .2331 | .0966 | |

TABLE VI

| | | |
|---|---|---|
| .3708 | R1 | TOP LAND RADIUS |
| .1034 | R2 | FIRST LAND INNER RADIUS |

TABLE VI-continued

| | | |
|---|---|---|
| .0523 | R3 | FIRST LAND OUTER RADIUS |
| .0523 | R4 | SECOND LAND OUTER RELIEF RADIUS |
| .0566 | R5 | SECOND LAND INNER RELIEF RADIUS |
| .0566 | R6 | SECOND LAND INNER RADIUS |
| .0335 | R7 | SECOND LAND OUTER RADIUS |
| .0335 | R8 | THIRD LAND OUTER RELIEF RADIUS |
| .0566 | R9 | THIRD LAND INNER RELIEF RADIUS |
| .0566 | R10 | THIRD LAND INNER RADIUS |
| .0298 | R11 | THIRD LAND OUTER RADIUS |
| .4276 | Y1 | FIRST TO SECOND LAND BEARING SURFACE DISTANCE |
| .0958 | Y3 | TOP LAND OUTER THICKNESS |
| .0604 | Y7 | SECOND LAND OUTER THICKNESS |
| .1816 | Y11 | BOTTOM LAND OUTER THICKNESS |
| .8120 | Y12 | FIRST TO THIRD LAND BEARING SURFACE DISTANCE |
| 1.8931 | CY2 | OUTER CONSTRUCTION ANGLE VERTEX LOCATION |
| .3275 | CY3 | TOP RADIUS CENTER LOCATION |
| 67.652368 | AN1 | LAND BEARING SURFACE ANGLE |
| 28.722320 | AN2 | LAND UNDERSIDE ANGLE |
| .0217 | D1 | OUTER ANGLE CONSTRUCTION POINT |
| .0271 | D2 | TOP RADIUS OFFSET |
| .1134 | D3 | LAND WIDTH |
| .0061 | D4 | BOTTOM OFFSET DISTANCE |
| .853669 | A1 | INNER CONSTRUCTION ANGLE |
| 16.652368 | A2 | OUTER CONSTRUCTION ANGLE |
| * | REFX,REFY | ELLIPTICAL FILLET X AND Y COORDINATE POINTS |
| 0.0 | 0.0 | |
| .0535 | 0.0 | |
| .0777 | .0015 | |
| .1008 | .0060 | |
| .1217 | .0129 | |
| .1401 | .0217 | |
| .1555 | .0317 | |
| .1683 | .0425 | |
| .1785 | .0537 | |
| .1864 | .0650 | |
| .1923 | .0763 | |
| .1965 | .0875 | |

TABLE VII

| | | |
|---|---|---|
| .3128 | R1 | TOP LAND RADIUS |
| .0873 | R2 | FIRST LAND INNER RADIUS |
| .0441 | R3 | FIRST LAND OUTER RADIUS |
| .0441 | R4 | SECOND LAND OUTER RELIEF RADIUS |
| .0477 | R5 | SECOND LAND INNER RELIEF RADIUS |
| .0477 | R6 | SECOND LAND INNER RADIUS |
| .0282 | R7 | SECOND LAND OUTER RADIUS |
| .0282 | R8 | THIRD LAND OUTER RELIEF RADIUS |
| .0477 | R9 | THIRD LAND INNER RELIEF RADIUS |
| .0477 | R10 | THIRD LAND INNER RADIUS |
| .0252 | R11 | THIRD LAND OUTER RADIUS |
| .3608 | Y1 | FIRST TO SECOND LAND BEARING SURFACE DISTANCE |
| .0809 | Y3 | TOP LAND OUTER THICKNESS |
| .0509 | Y7 | SECOND LAND OUTER THICKNESS |
| .1564 | Y11 | BOTTOM LAND OUTER THICKNESS |
| .6852 | Y12 | FIRST TO THIRD LAND BEARING SURFACE DISTANCE |
| 1.6907 | CY2 | OUTER CONSTRUCTION ANGLE VERTEX LOCATION |
| .2629 | CY3 | TOP RADIUS CENTER LOCATION |
| 67.652368 | AN1 | LAND BEARING SURFACE ANGLE |

TABLE VII-continued

| | | |
|---|---|---|
| 28.72232 | AN2 | LAND UNDERSIDE ANGLE |
| .0263 | D1 | OUTER ANGLE CONSTRUCTION POINT |
| .0229 | D2 | TOP RADIUS OFFSET |
| .0945 | D3 | LAND WIDTH |
| .0050 | D4 | BOTTOM OFFSET DISTANCE |
| .853669 | A1 | INNER CONSTRUCTION ANGLE |
| 15.652368 | A2 | OUTER CONSTRUCTION ANGLE |
| * | REFX,REFY | ELLIPTICAL FILLET X AND Y COORDINATE POINTS |
| .0000 | −.005 | |
| .0608 | −.005 | |
| .0814 | −.0037 | |
| .1009 | .0002 | |
| .1187 | .0061 | |
| .1341 | .0136 | |
| .1472 | .0222 | |
| .1578 | .0314 | |
| .1663 | .0409 | |
| .1728 | .0505 | |
| .1777 | .0601 | |
| .1810 | .0697 | |

TABLE VIII

| | | |
|---|---|---|
| .6094 | R1 | TOP LAND RADIUS |
| .17 | R2 | FIRST LAND OUTER RADIUS |
| .093 | R3 | FIRST LAND INNER RADIUS |
| .093 | R4 | SECOND LAND INNER RELIEF RADIUS |
| .085 | R5 | SECOND LAND OUTER RELIEF RADIUS |
| .085 | R6 | SECOND LAND OUTER RADIUS |
| .063 | R7 | SECOND LAND INNER RADIUS |
| .063 | R8 | THIRD LAND INNER RELIEF RADIUS |
| .085 | R9 | THIRD LAND OUTER RELIEF RADIUS |
| .085 | R10 | THIRD LAND OUTER RADIUS |
| .057 | R11 | THIRD LAND INNER RADIUS |
| .15 | R12 | BOTTOM RADIUS |
| .7028 | Y1 | FIRST TO SECOND LAND BEARING SURFACE DISTANCE |
| .1464 | Y3 | TOP LAND OUTER THICKNESS |
| .088 | Y7 | SECOND LAND OUTER THICKNESS |
| .3216 | Y11 | BOTTOM LAND OUTER THICKNESS |
| 1.3348 | Y12 | FIRST TO THIRD LAND BEARING SURFACE DISTANCE |
| 2.9817 | CY2 | OUTER CONSTRUCTION ANGLE VERTEX LOCATION |
| .5246 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0027 | D1 | OUTER ANGLE CONSTRUCTION POINT |
| .0496 | D2 | TOP RADIUS OFFSET |
| .1879 | D3 | LAND WIDTH |
| 0.0 | D4 | BOTTOM OFFSET DISTANCE |
| .853669 | A1 | INNER CONSTRUCTION ANGLE |
| 17.652368 | A2 | OUTER CONSTRUCTION ANGLE |

TABLE IX

| | | |
|---|---|---|
| .5214 | R1 | TOP LAND RADIUS |
| .1455 | R2 | FIRST LAND OUTER RADIUS |
| .0796 | R3 | FIRST LAND INNER RADIUS |
| .0796 | R4 | SECOND LAND INNER RELIEF RADIUS |
| .0727 | R5 | SECOND LAND OUTER RELIEF RADIUS |
| .0727 | R6 | SECOND LAND OUTER RADIUS |
| .0539 | R7 | SECOND LAND INNER RADIUS |
| .0539 | R8 | THIRD LAND INNER RELIEF RADIUS |
| .0727 | R9 | THIRD LAND OUTER RELIEF RADIUS |
| .0727 | R10 | THIRD LAND OUTER RADIUS |
| .0488 | R11 | THIRD LAND INNER RADIUS |
| .1283 | R12 | BOTTOM RADIUS |
| .6014 | Y1 | FIRST TO SECOND LAND BEARING SURFACE DISTANCE |
| .1238 | Y3 | TOP LAND OUTER THICKNESS |
| .0738 | Y7 | SECOND LAND OUTER THICKNESS |
| .2762 | Y11 | BOTTOM LAND OUTER THICKNESS |
| 1.1421 | Y12 | FIRST TO THIRD LAND BEARING SURFACE DISTANCE |
| 2.5554 | CY2 | OUTER CONSTRUCTION ANGLE VERTEX LOCATION |
| .4468 | CY3 | TOP RADIUS CENTER LOCATION |

TABLE IX-continued

| | | |
|---|---|---|
| 67.652368 | AN1 | LAND BEARING SURFACE ANGLE |
| 28.72232 | AN2 | LAND UNDERSIDE ANGLE |
| −.0001 | D1 | OUTER ANGLE CONSTRUCTION POINT |
| .0432 | D2 | TOP RADIUS OFFSET |
| .1606 | D3 | LAND WIDTH |
| 0.0 | D4 | BOTTOM OFFSET DISTANCE |
| 0.853669 | A1 | INNER CONSTRUCTION ANGLE |
| 17.652368 | A2 | OUTER CONSTRUCTION ANGLE |

TABLE X

| | | |
|---|---|---|
| .6094 | R1 | TOP LAND RADIUS |
| .17 | R2 | FIRST LAND OUTER RADIUS |
| .093 | R3 | FIRST LAND INNER RADIUS |
| .093 | R4 | SECOND LAND INNER RELIEF RADIUS |
| .085 | R5 | SECOND LAND OUTER RELIEF RADIUS |
| .085 | R6 | SECOND LAND OUTER RADIUS |
| .063 | R7 | SECOND LAND INNER RADIUS |
| .063 | R8 | THIRD LAND INNER RELIEF RADIUS |
| .085 | R9 | THIRD LAND OUTER RELIEF RADIUS |
| .085 | R10 | THIRD LAND OUTER RADIUS |
| .057 | R11 | THIRD LAND INNER RADIUS |
| .7028 | Y1 | FIRST TO SECOND LAND BEARING SURFACE DISTANCE |
| .1464 | Y3 | TOP LAND OUTER THICKNESS |
| .0880 | Y7 | SECOND LAND OUTER THICKNESS |
| .3216 | Y11 | BOTTOM LAND OUTER THICKNESS |
| 1.3348 | Y12 | FIRST TO THIRD LAND BEARING SURFACE DISTANCE |
| 2.9817 | CY2 | OUTER CONSTRUCTION ANGLE VERTEX LOCATION |
| .5246 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0027 | D1 | OUTER ANGLE CONSTRUCTION POINT |
| .0496 | D2 | TOP RADIUS OFFSET |
| .1879 | D3 | LAND WIDTH |
| .0000 | D4 | BOTTOM OFFSET DISTANCE |
| .853669 | A1 | INNER CONSTRUCTION ANGLE |
| 17.652368 | A2 | OUTER CONSTRUCTION ANGLE |
| * | GEFX,GEFY | ELLIPTICAL FILLET X AND Y COORDINATE POINTS |
| .0 | .0 | |
| .0785 | .0000 | |
| .1132 | .0022 | |
| .1464 | .0086 | |
| .1771 | .0186 | |
| .2044 | .0314 | |
| .2279 | .0465 | |
| .2477 | .0629 | |
| .2638 | 0802 | |
| .2765 | .0978 | |
| .2863 | .1159 | |
| .2934 | .1339 | |

TABLE XI

| | | |
|---|---|---|
| 0.5214 | R1 | TOP LAND RADIUS |
| .1455 | R2 | FIRST LAND OUTER RADIUS |
| .0796 | R3 | FIRST LAND INNER RADIUS |
| .0796 | R4 | SECOND LAND INNER RELIEF RADIUS |
| .0727 | R5 | SECOND LAND OUTER RELIEF RADIUS |
| .0727 | R6 | SECOND LAND OUTER RADIUS |
| .0539 | R7 | SECOND LAND INNER RADIUS |
| .0539 | R8 | THIRD LAND INNER RELIEF RADIUS |
| .0727 | R9 | THIRD LAND OUTER RELIEF RADIUS |
| .0727 | R10 | THIRD LAND OUTER RADIUS |
| .0488 | R11 | THIRD LAND INNER RADIUS |

TABLE XI-continued

| | | |
|---|---|---|
| .6014 | Y1 | FIRST TO SECOND LAND BEARING SURFACE DISTANCE |
| .1238 | Y3 | TOP LAND OUTER THICKNESS |
| .0738 | Y7 | SECOND LAND OUTER THICKNESS |
| .2762 | Y11 | BOTTOM LAND OUTER THICKNESS |
| 1.1421 | Y12 | FIRST TO THIRD LAND BEARING SURFACE DISTANCE |
| 2.5554 | CY2 | OUTER CONSTRUCTION ANGLE VERTEX LOCATION |
| .4468 | CY3 | TOP RADIUS CENTER LOCATION |
| 67.652368 | AN1 | LAND BEARING SURFACE ANGLE |
| 28.722320 | AN2 | LAND UNDERSIDE ANGLE |
| −.0001 | D1 | OUTER ANGLE CONSTRUCTION POINT |
| .0432 | D2 | TOP RADIUS OFFSET |
| .1606 | D3 | LAND WIDTH |
| 0.0 | D4 | BOTTOM OFFSET DISTANCE |
| .853669 | A1 | INNER CONSTRUCTION ANGLE |
| 17.652368 | A2 | OUTER CONSTRUCTION ANGLE |
| * | GEFX,GEFY | ELLIPTICAL FILLET X AND Y COORDINATE POINTS |
| 0.0 | 0.0 | |
| .0680 | 0.0 | |
| .0977 | .0019 | |
| .1261 | .0074 | |
| .1523 | .0159 | |
| .1757 | .0269 | |
| .1958 | .0398 | |
| .2127 | .0538 | |
| .2265 | 0686 | |
| .2374 | .0837 | |
| .2458 | .0992 | |
| .2518 | .1146 | |

TABLE XII

| | | |
|---|---|---|
| .4328 | R1 | TOP LAND RADIUS |
| .1177 | R2 | FIRST LAND OUTER RADIUS |
| .0671 | R3 | FIRST LAND INNER RADIUS |
| .0671 | R4 | SECOND LAND INNER RELIEF RADIUS |
| .0621 | R5 | SECOND LAND OUTER RELIEF RADIUS |
| .0621 | R6 | SECOND LAND OUTER RADIUS |
| .0447 | R7 | SECOND LAND INNER RADIUS |
| .0447 | R8 | THIRD LAND INNER RELIEF RADIUS |
| .0621 | R9 | THIRD LAND OUTER RELIEF RADIUS |
| .0621 | R10 | THIRD LAND OUTER RADIUS |
| .0404 | R11 | THIRD LAND INNER RADIUS |
| .5072 | Y1 | FIRST TO SECOND LAND BEARING SURFACE DISTANCE |
| .1037 | Y3 | TOP LAND OUTER THICKNESS |
| .0616 | Y7 | SECOND LAND OUTER THICKNESS |
| .2242 | Y11 | BOTTOM LAND OUTER THICKNESS |
| .9632 | Y12 | FIRST TO THIRD LAND BEARING SURFACE DISTANCE |
| 2.2691 | CY2 | OUTER CONSTRUCTION ANGLE VERTEX LOCATION |
| .3835 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0207 | D1 | OUTER ANGLE CONSTRUCTION POINT |
| .0322 | D2 | TOP RADIUS OFFSET |
| .1341 | D3 | LAND WIDTH |
| 0.0 | D4 | BOTTOM OFFSET DISTANCE |
| .853669 | A1 | INNER CONSTRUCTION ANGLE |
| 16.652368 | A2 | OUTER CONSTRUCTION ANGLE |
| * | GEFX,GEFY | ELLIPTICAL FILLET X AND Y COORDINATE POINTS |
| 0.0 | 0.0 | |
| .069 | 0.0 | |
| .0977 | .0018 | |

TABLE XII-continued

| | |
|---|---|
| .1251 | .0071 |
| .1499 | .0153 |
| .1717 | .0258 |
| .1900 | 0376 |
| .2051 | .0504 |
| .2172 | .0637 |
| .2266 | .0771 |
| .2336 | .0905 |
| .2386 | .1038 |

TABLE XIII

| | | |
|---|---|---|
| .3638 | R1 | TOP LAND RADIUS |
| .0984 | R2 | FIRST LAND OUTER RADIUS |
| .0573 | R3 | FIRST LAND INNER RADIUS |
| .0573 | R4 | SECOND LAND INNER RELIEF RADIUS |
| .0516 | R5 | SECOND LAND OUTER RELIEF RADIUS |
| .0516 | R6 | SECOND LAND OUTER RADIUS |
| .0385 | R7 | SECOND LAND INNER RADIUS |
| .0385 | R8 | THIRD LAND INNER RELIEF RADIUS |
| .0516 | R9 | THIRD LAND OUTER RELIEF RADIUS |
| .0516 | R10 | THIRD LAND OUTER RADIUS |
| .0348 | R11 | THIRD LAND INNER RADIUS |
| .4276 | Y1 | FIRST TO SECOND LAND BEARING SURFACE DISTANCE |
| .0858 | Y3 | TOP LAND OUTER THICKNESS |
| .0504 | Y7 | SECOND LAND OUTER THICKNESS |
| .1893 | Y11 | BOTTOM LAND OUTER THICKNESS |
| .8120 | Y12 | FIRST TO THIRD LAND BEARING SURFACE DISTANCE |
| 1.9165 | CY2 | OUTER CONSTRUCTION ANGLE VERTEX LOCATION |
| .3225 | CY3 | TOP RADIUS CENTER LOCATION |
| 67.652368 | AN1 | LAND BEARING SURFACE ANGLE |
| 28.722320 | AN2 | LAND UNDERSIDE ANGLE |
| .0167 | D1 | OUTER ANGLE CONSTRUCTION POINT |
| .0271 | D2 | TOP RADIUS OFFSET |
| .1130 | D3 | LAND WIDTH |
| 0.0 | D4 | BOTTOM OFFSET DISTANCE |
| .853669 | A1 | INNER CONSTRUCTION ANGLE |
| 16.652368 | A2 | OUTER CONSTRUCTION ANGLE |
| * | GEFX,GEFY | ELLIPTICAL FILLET X AND Y COORDINATE POINTS |
| 0.0 | 0.0 | |
| .0590 | 0.0 | |
| .0832 | .0015 | |
| .1063 | .0060 | |
| .1272 | .0129 | |
| .1456 | .0217 | |
| .1610 | .0317 | |
| .1738 | .0425 | |
| .1840 | .0537 | |
| .1919 | .0650 | |
| .1978 | .0763 | |
| .2020 | .0875 | |

TABLE XIV

| | | |
|---|---|---|
| .3058 | R1 | TOP LAND RADIUS |
| .0823 | R2 | FIRST LAND OUTER RADIUS |
| .0491 | R3 | FIRST LAND INNER RADIUS |
| .0491 | R4 | SECOND LAND INNER RELIEF RADIUS |
| .0427 | R5 | SECOND LAND OUTER RELIEF RADIUS |
| .0427 | R6 | SECOND LAND OUTER RADIUS |
| .0332 | R7 | SECOND LAND INNER RADIUS |
| .0332 | R8 | THIRD LAND INNER RELIEF RADIUS |
| .0427 | R9 | THIRD LAND OUTER RELIEF RADIUS |
| .0427 | R10 | THIRD LAND OUTER RADIUS |

TABLE XIV-continued

| | | |
|---|---|---|
| .0302 | R11 | THIRD LAND INNER RADIUS |
| .3608 | Y1 | FIRST TO SECOND LAND BEARING SURFACE DISTANCE |
| .0709 | Y3 | TOP LAND OUTER THICKNESS |
| .0409 | Y7 | SECOND LAND OUTER THICKNESS |
| .163 | Y11 | BOTTOM LAND OUTER THICKNESS |
| .68520 | Y12 | FIRST TO THIRD LAND BEARING SURFACE DISTANCE |
| 1.7157 | CY2 | OUTER CONSTRUCTION ANGLE VERTEX LOCATION |
| .2579 | CY3 | TOP RADIUS CENTER LOCATION |
| 67.652368 | AN1 | LAND BEARING SURFACE ANGLE |
| 28.72232 | AN2 | LAND UNDERSIDE ANGLE |
| .0213 | D1 | OUTER ANGLE CONSTRUCTION POINT |
| .0229 | D2 | TOP RADIUS OFFSET |
| .0941 | D3 | LAND WIDTH |
| 0.0 | D4 | BOTTOM OFFSET DISTANCE |
| .853669 | A1 | INNER CONSTRUCTION ANGLE |
| 15.652368 | A2 | OUTER CONSTRUCTION ANGLE |
| * | GEFX,GEFY | ELLIPTICAL FILLET X AND Y COORDINATE POINTS |
| 0.0 | 0.0 | |
| .0664 | 0.0 | |
| .087 | .0013 | |
| .1065 | .0052 | |
| .1243 | .0111 | |
| .1397 | .0186 | |
| .1528 | .0272 | |
| .1634 | .0364 | |
| .1719 | .0459 | |
| .1784 | .0555 | |
| .1833 | .0651 | |
| .1866 | .0747 | |

We claim:

1. A bilaterally serrated steeple shaped side entry root, symmetric about a surface of symmetry, for attaching a turbine blade to a rotor, the rotor having a longitudinal axis of symmetry, the blade having a foil portion and a platform interposed between the foil portion and said root, said root positionable in a complementary steeple shaped groove disposed about the turbine rotor, said root comprising:

an upper serrated portion positioned against the platform, said upper portion including a pair of upper tangs symmetrically arranged on opposite sides of said root, a pair of upper fillets each spaced a distance d apart and having a radius of curvature, rt, of at least 0.14 d, each upper fillet positioned between a corresponding one of the upper tangs and the platform, and a pair of upper lands, each of the lands being positioned between a corresponding one of the fillets and an associated one of the tangs, the upper lands having a projected width, wt, no greater than 0.56 rt, said projected width taken along a plane perpendicular to the surface of symmetry and parallel to the rotor axis for the transmission of centrifugal forces between the turbine blade and the rotor;

a middle serrated portion extending from said upper portion in a direction away from the platform, said middle portion including a pair of middle tangs symmetrically arranged on opposite sides of said root, a pair of middle fillets each having a radius of curvature, rm, of at least 0.08 d, each middle fillet positioned between an upper tank and a middle tang on opposite sides of said root, each middle fillet adjoining a different middle land, and two middle lands, each of the middle lands having a projected width, wm, no greater than 1.15 rm, each middle land being interposed between a middle fillet and a middle tang for the transmission of forces between the turbine blade and the rotor; and a lower serrated portion extending from said middle portion in a direction away from the platform, said lower portion including a pair of lower tangs symmetrically arranged on opposite sides of said root, a pair of lower fillets each having a radius of curvature, rb, at least 0.08 d, each lower fillet positioned between a middle tang and a lower tang on opposite sides of said root, each lower fillet adjoining a different lower land, and the two lower lands each having a projected width, wb, no greater than 1.1 rb, each lower land interposed between a lower fillet and a lower tang for the transmission of forces between the turbine blade and the rotor.

2. A bilaterally serrated steeple shaped side entry root, symmetric about a surface of symmetry, for attaching a turbine blade to a rotor, the rotor having a longitudinal axis of symmetry, the blade having a foil portion and a platform interposed between the blade portion and said root, said root positionable in a complementary steeple shaped groove disposed about the turbine rotor, said root comprising:

an upper serrated portion positioned against the platform, said upper portion including a pair of upper tangs symmetrically arranged on opposite sides of said root, a pair of upper fillets each spaced a distance d apart and having a radius of curvature, rt, of at least 0.13 d, each upper fillet positioned between a corresponding one of the upper tangs and the platform, and a pair of upper lands, each of the lands being positioned between a corresponding one of the fillets and an associated one of the tangs, the upper lands having a projected width, wt, no greater than 0.65 rt, said projected width taken along a plane perpendicular to the surface of symmetry and parallel to the rotor axis for the transmission of centrifugal forces between the turbine blade and the rotor;

a middle serrated portion extending from said upper portion in a direction away from the platform, said middle portion including a pair of middle tangs symmetrically arranged on opposite sides of said root, a pair of middle fillets each having a radius of curvature, rm, of at least 0.075 d, each middle fillet positioned between an upper tang and a middle tang on opposite sides of said root, each middle fillet adjoining a different middle land, and two middle lands, each of the middle lands having a projected width, wm, no greater than 1.25 rm, each middle land being interposed between a middle fillet and a middle tang for the transmission of forces between the turbine blade and the rotor; and a lower serrated portion extending from said middle portion in a direction away from the platform, said lower portion including a pair of lower tangs symmetrically arranged on opposite sides of said root, a pair of lower fillets each having a radius of curvature, rb, at least 0.075 d, each lower fillet positioned between a middle tang and a lower tang on opposite sides of said root, each lower fillet adjoining a different lower land, the two lands each having a projected width, wb, no greater than 1.25 rb, each lower land interposed between a lower fillet and a lower tang for the transmission of forces between the turbine blade and the rotor.

3. A bilaterally serrated steeple shaped side entry root, symmetric about a surface of symmetry, for attaching a turbine blade to a rotor, the rotor having a longitudinal axis of symmetry, the blade having a foil portion adjoining said root, said root positionable in a complementary steeple shaped groove disposed about the turbine rotor, said root comprising:

an upper serrated portion adjoining the foil portion, said upper portion including a pair of upper tangs symmetrically arranged on opposite sides of said root, a pair of upper fillets each spaced a distance d apart and having a radius of curvature, rt, of at least 0.14 d, each upper fillet positioned between a corresponding one of the upper tangs and the foil portion, and a pair of upper lands, each of the lands being positioned between a corresponding one of the fillets and an associated one of the tangs, the upper lands having a projected width, wt, no greater than 0.56 rt, said projected width taken along a plane perpendicular to the surface of symmetry and parallel to the rotor axis for the transmission of centrifugal forces between the turbine blade and the rotor;

a middle serrated portion extending from said upper portion in a direction away from the foil portion, said middle portion including a pair of middle tangs symmetrically arranged on opposite sides of said root, a pair of middle fillets each having a radius of curvature, rm, of at least 0.08 d, each middle fillet positioned between an upper tang and a middle tang on opposite sides of said root, each middle fillet adjoining a different middle land, and two middle lands, each of the middle lands having a projected width, wm, no greater than 1.15 rm, each middle land being interposed between a middle fillet and a middle tang for the transmission of forces between the turbine blade and the rotor; and a lower serrated portion extending from said middle portion in a direction away from the foil portion, said lower portion including a pair of lower tangs symmetrically arranged on opposite sides of said root, a pair of lower fillets each having a radius of curvature, rb, at least 0.08 d, each lower fillet positioned between a middle tang and a lower tang on opposite sides of said root, each lower fillet adjoining a different lower land, the two lower lands each having a projected width, wb, no greater than 1.1 rb, each lower land interposed between a lower fillet and a lower tang for the transmission of forces between the turbine blade and the rotor.

4. A bilaterally serrated steeple shaped side entry root, symmetric about a surface of symmetry, for attaching a turbine blade to a rotor, the rotor having a longitudinal axis of symmetry, the blade having a foil portion adjoining said root, said root positionable in a complementary steeple shaped groove disposed about the turbine rotor, said root comprising:

an upper serrated portion positioned against the foil portion, said upper portion including a pair of upper tangs symmetrically arranged on opposite sides of said root, a pair of upper fillets each spaced a distance d apart and having a radius of curvature, rt, of at least 0.13 d, each upper fillet positioned between a corresponding one of the upper tangs and the foil portion, and a pair of upper lands, each of the lands being positioned between a corresponding one of the fillets and an associated one of the tangs, the upper lands having a projected width, wt, no greater than 0.65 rt, said projected width taken along a plane perpendicular to the surface of symmetry and parallel to the rotor axis for the transmission of centrifugal forces between the turbine blade and the rotor;

a middle serrated portion extending from said upper portion in a direction away from the foil portion, said middle portion including a pair of middle tangs symmetrically arranged on opposite sides of said root, a pair of middle fillets each having a radius of curvature, rm, of at least 0.075 d, each middle fillet positioned between an upper tang and a middle tang on opposite sides of said root, each middle fillet adjoining a different middle land, and two middle lands, each of the middle lands having a projected width, wm, no greater than 1.25 rm, each middle land being interposed between a middle fillet and a middle tang for the transmission of forces between the turbine blade and the rotor; and a lower serrated portion extending from said middle portion in a direction away from the foil portion, said lower portion including a pair of lower tangs symmetrically arranged on opposite sides of said root, a pair of lower fillets each having a radius of curvature, rb, at least 0.075 d, each lower fillet positioned between a middle tang and a lower tang on opposite sides of said root, each lower fillet adjoining a different lower land, the two lower lands each having a projected width, wb, no greater than 1.25 rb, each lower land interposed between a lower fillet and a lower tang for the transmission of forces between the turbine blade and the rotor.

5. A plurality of steeples arranged in a circular array about a turbine rotor, adjacent steeples defining a groove therebetween for receiving a turbine blade root, each steeple comprising:

a lower serrated portion positioned against the rotor, said lower portion including a pair of lower tangs symmetrically arranged on opposite sides of the steeple and each having a radius of curvature sb, each lower fillet positioned between a different lower tang and the rotor, and two lower lands each having a projected land width wb, each lower land interposed between a lower fillet and a lower tang for receiving forces from the blade root;

a middle serrated portion extending from said lower portion in a radial direction with respect to the rotor, said middle portion including a pair of middle tangs symmetrically arranged on opposite sides of the steeple, a pair of middle fillets having a radius of curvature sm, each middle fillet positioned between a lower tang and a middle tang, and two middle lands each having a projected land width wm, each land interposed between a middle fillet and a middle tang for receiving forces from the blade root; and an upper serrated portion extending from said middle portion in a radial direction with respect to the rotor, said upper portion including a pair of upper tangs symmetrically arranged on opposite sides of the steeple, a pair of upper fillets each having a radius of curvature, st, of at least 0.08 d, each upper fillet positioned between a middle tang and an upper tang, and two upper lands each having a projected land width wt, each land interposed between an upper fillet and an upper tang for receiving forces from the blade root.

6. A plurality of steeples arranged in a circular array about a turbine rotor, adjacent steeples defining a groove therebetween for receiving a turbine blade root, each steeple comprising:

a lower serrated portion positioned against the rotor, said lower portion including a pair of lower tangs symmetrically arranged on opposite sides of the steeple and each having a radius of curvature sb, each lower fillet positioned between a different lower tang and the rotor, and two lower lands each having a projected land width wb, each lower land interposed between a lower fillet and a lower tang for receiving forces from the blade root;

a middle serrated portion extending from said lower portion in a radial direction with respect to the rotor, said middle portion including a pair of middle tangs symmetrically arranged on opposite sides of the steeple, a pair of middle fillets each having a radius of curvature sm, each middle fillet positioned between a lower tang and a middle tang, and two middle lands each having a projected land with wm, each land interposed between a middle fillet and a middle tang for receiving forces from the blade root; and an upper serrated portion extending from said middle portion in a radial direction with respect to the rotor, said upper portion including a pair of upper tangs symmetrically arranged on opposite sides of the steeple, a pair of upper fillets each having a radius of curvature, st, of at least 0.07 d, each upper fillet positioned between a middle tang and an upper tang, and two upper lands each having a projected land width wt, each land interposed between an upper fillet and an upper tang for receiving forces from the blade root.

7. A bilaterally serrated side entry root for securing a turbine blade in one of a plurality of rotor grooves formed between a plurality of bilaterally serrated steeples arranged in a circular array about a turbine rotor, each steeple having first and second symmetric sides, each steeple side including a lower land extending from the rotor, a middle land extending outward from the rotor beyond the lower land and an upper land extending outward from the rotor beyond the middle land for receiving forces from said root, each of the lands on each steeple side substantially parallel to one another, the middle steeple land spaced a distance sx from the upper steeple land and the lower steeple land spaced a distance sy from the upper steeple land on each steeple side, said root comprising:

first and second symmetric sides, each side positionable against a steeple side, each root side including an upper root land positionable adjacent an upper steeple land, a middle root land positionable against a middle steeple land and a lower root land positionable against a lower steeple land, each of the lands on each root side substantially parallel to one another, the middle root land spaced a distance rx from the upper root land and the lower root land spaced a distance ry from the upper root land so that when said root is positioned in a stationary rotor groove:

the upper root land is spaced a distance ranging between 0.000" and 0.0001" from an upper steeple land;

the middle root land is spaced a distance ranging between 0.000" and 0.0009" from the middle steeple land; and the lower root land is spaced a distance ranging between 0.000" and 0.0006" from the lower steeple land.

8. The root of claim 7 positionable in a groove formed by adjacent steeples, each steeple having sx range between 0.6013" and 0.6018' and sy range between 1.1420" and 1.1425", wherein rx ranges between 0.6013" and 0.6018" and ry ranges between 1.1420" and 1.1425".

9. A method of reducing stress in turbine blade attachment structures of the type having an inverted fir tree shaped root with a plurality of horizontally extending tangs on each side of the root spaced apart by fillets projecting into the root, each of the tangs having a load supporting land defined between an outer edge of an associated tang and a corresponding fillet, d being the distance between oppositely positioned fillets at the widest portion of the root, rt being the radius of curvature of the fillets at the widest portion of the root, the method comprising the steps of:

decreasing the width of the load supporting land at the widest portion of the root to a value less than 0.67 rt; and increasing the radius of curvature of the fillet at the widest portion of the root to a value greater than 0.9 d.

10. The method of claim 9 wherein the root has at least three tangs and three fillets on each side thereof, rm being the radius of curvature of a middle fillet and rb being a radius of curvature of a fillet at the narrowest portion of the root, each tang having a load supporting land termining in a corresponding adjacent one of the fillets, the method further including the steps of:

decreasing the width of the land adjacent the middle fillet of the root to a value less than 1.38 rm; and increasing the radius of curvature of the middle fillet of the root to a value greater than 0.05 d.

11. The method of claim 10 and including the steps of:

decreasing the width of the land adjacent the narrowest portion of the root to a value less than 1.38 rb; and increasing the radius of curvature of the fillet at the narrowest portion of the root to a value greater than 0.05 d.

* * * * *